United States Patent [19]

Meder

[11] 4,074,866

[45] Feb. 21, 1978

[54] RELEASABLE COMPRESSION DEVICE FOR USE WITH A CRUSHING MILL OR THE LIKE

[75] Inventor: Heinz Meder, Forsbach, Germany

[73] Assignee: Klockner-Humboldt-Deutz Aktiengesellschaft, Germany

[21] Appl. No.: 720,369

[22] Filed: Sept. 3, 1976

[30] Foreign Application Priority Data

Sept. 10, 1975 Germany ..... 2540269

[51] Int. Cl.[2] ..... B02C 4/32

[52] U.S. Cl. ..... 241/30; 241/231; 241/232

[58] Field of Search ..... 241/30, 230, 231, 232, 241/234

[56] References Cited

U.S. PATENT DOCUMENTS

| | | | |
|---|---|---|---|
| 2,713,460 | 7/1955 | Atkinson | 241/232 X |
| 3,099,406 | 7/1963 | Kautz | 241/231 X |
| 3,208,678 | 9/1965 | Pick et al. | 241/234 X |
| 3,478,972 | 11/1969 | Hansen | 241/230 |
| 3,938,732 | 2/1976 | Schrimper et al. | 241/231 |

*Primary Examiner*—Roy Lake
*Assistant Examiner*—Howard N. Goldberg
*Attorney, Agent, or Firm*—Hill, Gross, Simpson, Van Santen, Steadman, Chiara & Simpson

[57] ABSTRACT

A conventional rolling or crushing mill is provided with a fixed roller and an adjustable roller carried in a pivotable support to allow adjustment of the size of a nip formed between the rollers. Adjustment of the nip dimension is accomplished by operatively connecting the pivotable support between an upper and a lower threaded nut carried on a pivotably mounted threaded rod. Between the connection between the pivotable roller support and the lower nut is a hydraulically actuated cylinder into which is introduced a hydraulic fluid at a selected pressure from a supply to maintain the support against the upper nut under pressure and thereby maintain the adjustable roller under a like pressure during the crushing operation. If a foreign object becomes engaged in the nip, whereby the crushing pressure is exceeded, the size of the nip increases forcing fluid from the cylinder and into an accumulator connected in the supply so as to allow the foreign object to pass without unduly damaging the rollers.

15 Claims, 2 Drawing Figures

RELEASABLE COMPRESSION DEVICE FOR USE WITH A CRUSHING MILL OR THE LIKE

BACKGROUND OF THE INVENTION

1. Field of the Invention

This invention relates to a releasable compression device for use on a rolling or crushing mill and more particularly to a device which maintains a constant crushing pressure on crushing rolls of the mill while at the same time allowing one of the rollers to pivot outwardly to allow a passage of a foreign object if such is encountered.

2. Description of the Prior Art

A rolling or crushing mill for processing such hard materials as Carborundum into a finely controlled particle size has been available and known in the art for some time. Particle size of the material processed by such a mill is controlled by the dimension of the nip formed between the crushing rollers.

It has been customary in such a mill to have one roller fixed in location while a second roller is supported in a pivotable frame which allows adjustment of the nip dimension as well as a momentary increase in the nip dimension in case the supply of raw material includes a foreign object which cannot be crushed and could cause damage to the surface of the rollers if the nip were not expandable.

Initial adjustment of the nip between the rollers has been perfected by providing a pivotable support frame for the adjustable roller with a lever arm which is carried between two adjustable nuts on a threaded rod. By adjusting the position of the lower nut and then tightening the upper nut accordingly, the relative position of the pivotable roller is maintained to establish the desired dimension of the nip between the fixed and adjustable roller. Any force tending to increase the nip dimension is resisted by the structure of the mill.

Under these conditions, the only safety feature against overstress of the structure because of a change in conditions of the raw material entering the crusher or upon entry of a foreign body into the roller nip, is the strength of the individual components of the mill.

As an added safety feature, some mills use a breakaway or hinge bearing which fails at a certain stress point.

Additionally, hydraulic supporting devices have been incorporated for use with a rolling or crushing mill to position the adjustable roller and thereby control the dimension of the nip. Examples of such a device are disclosed in German Specification No. 1,584,592. Also, German Patent No. 946,676 discloses a controllable hydraulic pressure apparatus for a roller or crushing mill in which a friction bar is incorporated with the roller. German Patent No. 1,083,104 also discloses a hydraulic pressure apparatus for a roller or a crusher mill about which a spring loaded pressure adjusted valve apparatus is incorporated to regulate the operating pressure of the rollers.

SUMMARY OF THE INVENTION

A rolling or crushing mill incorporating the invention as disclosed includes a first roller carried in a fixed position on a rigid base or frame. Adjacent to the fixed roller is a second roller mounted in a pivotable support frame which allows a user to adjust the nip dimension formed between the fixed and the second or adjustable roller.

The adjustable roller is carried in an L-shaped frame having a substantially vertical arm which is pivotably attached to the base and a horizontal arm which is carried between two threaded nuts disposed on a substantially vertical rod also pivotably connected to the base.

The distance between the adjacent rollers or nip dimension is varied by loosening the top nut, adjusting the position of the lower nut to rotate the adjustable roller so as to provide the dimension of the nip desired, and then tightening the top nut against the horizontal arm of the L-shaped support frame to fix the position of the adjustable roller.

Because the L-shaped support bracket is pivotably mounted as is the threaded rod, any dimensional change in the nip changes the angle at which the substantially horizontal arm joins the threaded rod. To provide for this change in angle and to assure proper alignment between the threaded rod and a vertical aperture in the horizontal arm through which the vertical rod is disposed, an upper and a lower socket are incorporated between the upper and the lower nut and the arm.

Between the lower socket and the lower nut is a hydraulic cylinder having an annular groove in which a like dimensioned annular piston is dispoed to provide therein a chamber. The cylinder is provided with a fluid port into the groove, so as to allow a flow of hydraulic fluid in and out of the chamber provided therein.

A hydraulic fluid supply system connects with the fluid port of the cylinder and includes a pumping means, a gauge by which the pressure of the fluid in the system can be measured, a shut-off valve between the pumping means and the cylinder inlet and an inert gas filled accumulator located between the shut-off valve and the port cylinder. The accumulator is positioned at an elevation above the port. Using the pumping means, the piston can be subjected to a desired fluid pressure which in turn maintains the joint formed between the upper and lower nut, the socket, and the hydraulic cylinder and piston under a like pressure.

During operation, matter to be crushed is fed between the fixed roller an the adjustable roller. The crushing force in the nip between the rollers is equal to approximately the force maintained by the hydraulic fluid on the piston. Since this force is adjustable, it may be regulated with respect to the type of raw material being crushed or otherwise ground or rolled.

If a foreign object having a dimension greater than the nip becomes positoned between the fixed and adjustable roller and cannot be crushed therebetween, the adjustable roller is forced outwardly to rotate the support frame clockwise so as to cause a downward movement of the arm attached to the threaded rod which in turn causes the piston to displace hydraulic fluid from the chamber within the cylinder. A volume of hydraulic fluid equal to the volume of displaced fluid enters the accumulator where it is stored until the foreign object has passed. The hydraulic fluid then returns to the chamber to move the piston upward and restore the adjustable roller to its original position.

There are several significant advantages to the device as disclosed by this invention. First, the device may be readily adapted to existing rolling and crushing mills without extensive modification.

Second, the force on the adjustable roller to provide the crushing or rolling action in the nip is adjustable and maintained at a practically constant level. The output from the rolling or crushing mill, therefore, has an unusually uniform particle size.

Additionally, the device provides a means by which a foreign object can be passed between the crushing rollers without undue damage to the rollers. One crushing pressure has been exceeded, the dimension of the nip increases so as to allow the passage of the oversized object.

A further advantage is that the crushing pressure may be adjusted with respect to the raw material being processed and once so adjusted, maintained at that pressure by a minimum amount of human supervision.

DESCRIPTION OF THE PREFERRED EMBODIMENTS

Figure 1:
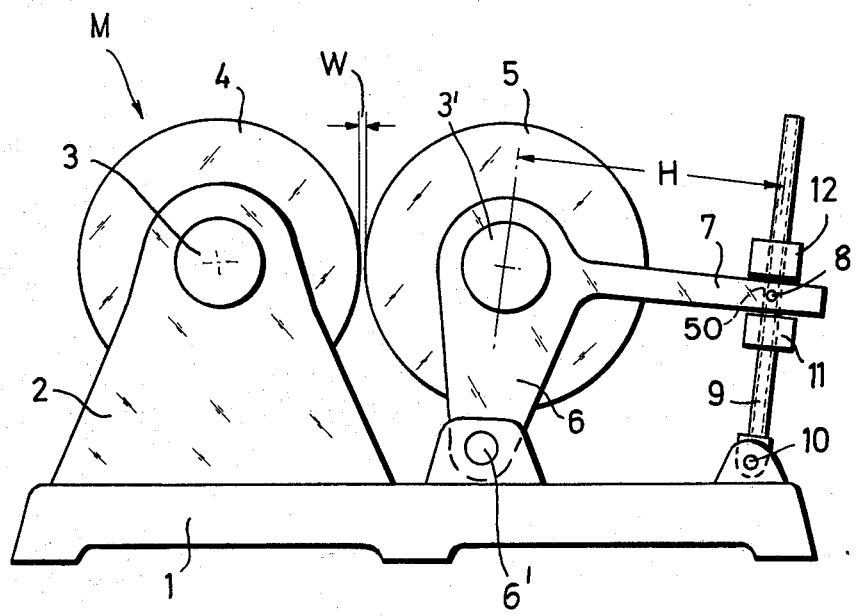
FIG. 1 is an elevational view of a typical rolling or crushing mill according to this invention.

As best seen in FIG. 1, a rolling or crushing mill is shown generally at M and includes a base 1 which carries a fixed upright 2 supporting a rotatable crushing roller 4 on a suitable shaft 3 having an end portion journaled by the upright 2.

A second rotatable crushing roller 5 is carried by a suitable shaft 3', having an end portion journaled by an L-shaped support frame 6 which is pivotably mounted to the base 1 at pivot point 6'.

The support frame 6 has a substantially horizontal arm portion 7 having an outer end with a vertical aperture 50 therethrough at a distance H from the shaft 3. A threaded rod 9 having a bottom end pivotably joined to the base 1 at a pivot point 10 passes through the aperture with sufficient clearance to provide a space 52 therebetween (See FIG. 2).

The end of the arm 7 is positioned between a lower threaded nut 11 and an upper threaded nut 12, threaded on the rod 9. The lower theaded nut 11 has an inner cylindrial body extending upwardly through the aperture 50.

Figure 2:
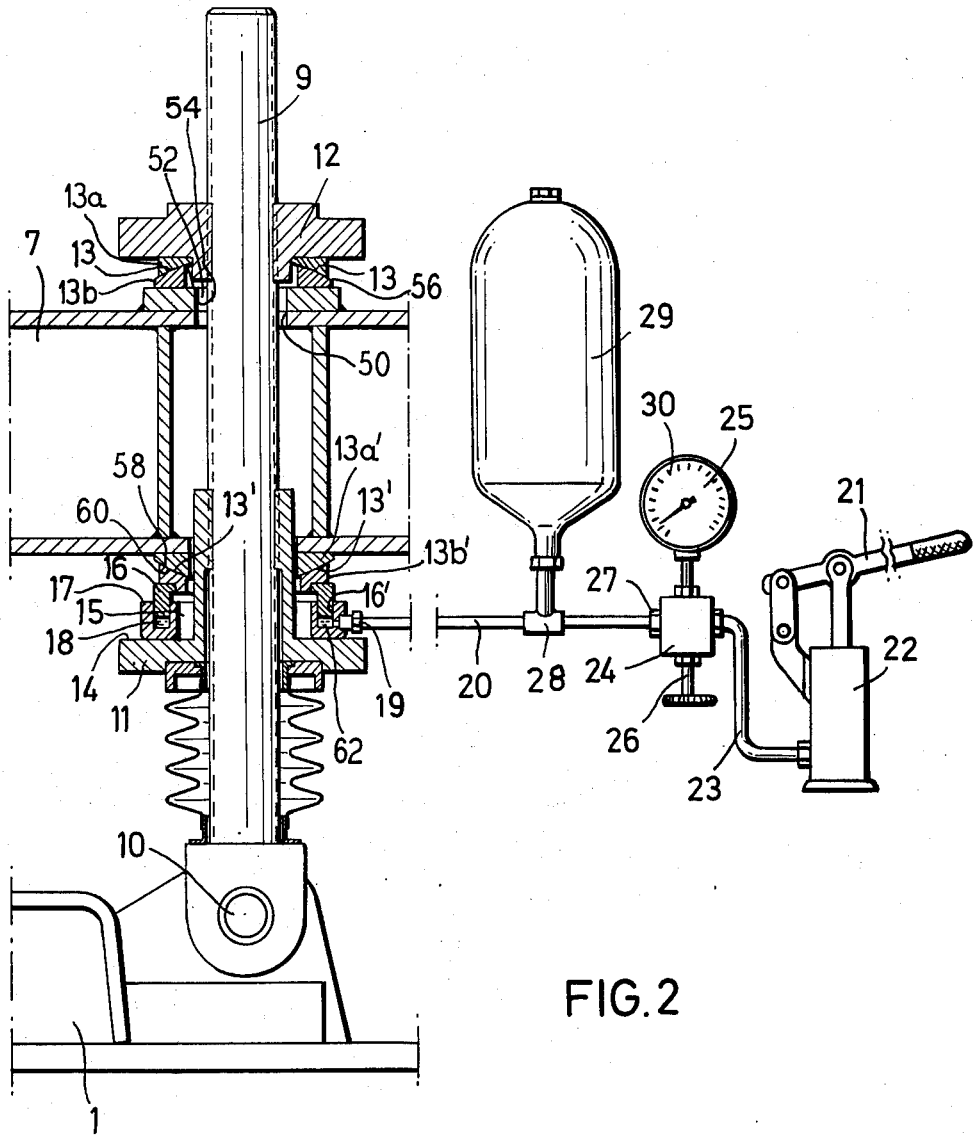
FIG. 2 is an elevational view in partial cross-section of a releasable compression device as used with the mill of FIG. 1.

Referring to FIG. 2, between the upper nut 12 and the arm 7 of the support frame 6 is a socket assembly 13 formed with an upper portion 13*a* and a lower portion 13*b*. The upper and lower portions 13*a* and 13*b* have an upper and lower mating surfaces 54 and 56 having a complementary semi-spherical configuration respectively.

Between the lower nut 11 and the arm 7 of the support frame 6 is a like socket assembly 13' formed with an upper portion 13*a*' and lower portion 13*b*' and also having like mating surfaces 58 and 60 having a complementary semi-spherical configuration respectively.

Betwween the lower socket portion 13*b*' and a top support surface 14 of the nut 11 is a hydraulic assembly 15 comprising a circular piston 16 slidably disposed in suitably proportioned annular groove 16' in a circular shaped cylinder 17 to form a chamber 18 therein.

By means of a suitable fluid port 19 connecting with the chamber 18, a supply of hydraulic fluid 62 can be introduced in the chamber 18 to cause the piston 16 to move upwardly against the lower socket portion 13*b*' of the lower socket assembly 13'.

A movement of the hydraulic fluid 62 into and out of the chamber 18 can be accomplished by use of a suitable pumping means such as a hand pump 21 having a reservoir 22 which connects with a valving means 24 by means of a pipe 23.

The valving means 24 includes a valve handle 26 by which flow from the pump 21 to the hydraulic assembly 15 can be restricted or shut off, a pressure gauge 25 and a suitable fitting 27 for the piping 20 to connect with the valving means 24. The piping 20 further includes a T-fitting 28 allowing connection with an inert gas filled accumulator 29.

The gauge 25 can have a face plate 30 calibrated in a standard measure of force per area or custom calibrated with respect to the configuration of the apparatus M.

During operation, the dimension W of the nip formed between the rollers 4 and 5 is adjusted as required by first rotating the upper nut 12 upwardly to allow free movement of the arm 7. Next the lower nut 11 is rotated to adjust the dimension W to produce the required nip. Then the upper nut 12 is rotated to produce a firm joint between the arm 7, the sockets 13 and 13', the hydraulic assembly 15, and the lower and the upper nuts 11 and 12.

By means of the pump 21, hydraulic fluid 62 is pumped into the chamber 18 of the cylinder 17 to further increase the pressure of the joint. The amount of pressure in the chamber 18 is indicated by the gauge 25 and upon reaching a desired level, valving means 24 is closed by manipulation of the handle 26, so as to prevent any pressure drop because of the pump 21.

It should be noted that introducing the hydraulic fluid 62 into the chamber 18 of the cylinder 17 has a negligible effect on the dimension "W" since the position of the upper nut 12 sets the minimum limit of "W" while the position of the lower nut 11 sets the maximum limit of "W." To insure that the clearance space 52 is maintained, the positions 13*a*, 13*b*, and 13*a*', and 13*b*' of sockets 13 and 13' can be adjusted accordingly.

During crushing, the roller 5 is maintained in the position set by the upper nut 12 by the foce exerted by the hydraulic fluid 62 against the piston 16. It should be noted that the force remains nearly constant regardless of the position of the roller 5 between the minimum and maximum limits of "W" as determined by the lower and the upper nuts 11 and 12.

As the roller 5 moves from "W" minimum toward "W" a volume of fluid 62 is displaced from the chamber 18 and a like volume is stored in the accumulator 29 causing only a slight increase in pressure since the volume of gas displaced is only a fraction of the total volume of the gas within the accumulator.

If during crushing or rolling by the rollers 4 and 5 of the mill M a foreign object is encountered which cannot be reduced to a dimension approximting "W" minimum by the force being applied to the roller 5, then the nip dimension can be increased to equal "W" maximum by applying a force exceeding the force on piston 16. It is anticipated that by increasing the nip dimension to equal "W" maximum, the foreign object can be passed without causing undue damage to the rollers 4 and 5.

Thus, in accordance with the method and mechanism above disclosed, a crushing nip is defined between a pair of parallel rollers with the second roller position relative to the first roller by an adjustable fixed stop. Movable roll positioning means for the second roller are held against the fixed stop by a biasing force in excess of that required to hold the rolls in their relative predetermined positions during normal operating pressures. The biasing means, however, yields with excessive pressures in the nip when a foreign object passes therethrough. The biasing means is preferably provided by a pressure chamber containing a hydraulic fluid and backed by a compressible gas with the pressure of the gas being adjustably controllable to hold the roll in its operating position against the fixed stop diuring normal operation, but to compress and permit it to move away to widen the nip when a large foreign object passes therethrough. The arrangement achieves the objectives and advantages above set forth and is so constructed so as to permit opening of the nip and yet permit it to be set to a fixed width and to maintain that width during normal operating conditions. Also, the nip width can be adjusted to a predetermined desired width without changing the function of yieldability of the nip when a foreign object passes therethrough. Also, the amount of biasing force maintaining the fixed width of the nip can be adjusted so that with temporary heavy loads the nip width will remain constant, and the rolls will separate only when a predetermined adjustable pressure in the nip is received as caused by the passage of a foreign object.

It will be apparent to those skilled in the art that many modifications and variations may be effected without departing from the spirit and scope of the novel concepts of the present invention.

I claim as my invention:

1. A crushing mill having a releasable compression device to allow the non-destructive passage of foreign matter through said mill comprising:

a mill body having a base carrying a fixed upright;

a first roller rotatably carried by said fixed upright;

a second roller rotatably carried by an L-shaped support frame having a substantially vertical arm portion pivotally attached to said base to allow adjustment of a nip formed between said rollers;

a substantially horizontal arm portion having a vertical aperture in the end thereof carried by said support frame;

a threaded rod disposed in said aperture and having a bottom end pivotably attached to said base;

an upper and lower threaded nut carried on said rod and positioned above and below said arm of said support frame;

roatational socket means carried by said threaded rod between said arm and said upper and lower nuts to provide a slidng fit between said rod and said aperture;

a compression means carried between said rotational socket means and said lower nut to produce a compression joint between said nuts and said arm; and pressure means connected to said compression means to supply a selective pressure to said compression means;

whereby a maximum and minimum dimensional limit of said nip is fixed by said upper and said lower nut and said second roller can adjust between said limits as a function of said selected pressure.

2. A releasble compression device to provide a constant crushing force to a nip formed by a pair of rollers of a crushing mill and allow said nip to expand selectively, comprising:

an L-shaped support pivotably attached to said mill and carrying one of said rollers to provide means to adjust a dimension of said nip, said support having an elongated horizontal positioned arm with a vertical opening through an end of said arm;

an elongated, vertically positioned threaded rod having a bottom end pivotably attached to said mill and an upper end disposed in said opening through said arm;

an upper and a lower socket assembly comprising upper and lower adjustable portions respectively, said upper assembly carried by said rod above said opening and said lower assembly carried by said rod below said opening;

a hydraulic assembly including a cylinder having a groove and a piston vertically disposed in said groove with a slidable fit, said assembly disposed on said rod below said lower socket;

an upper and a lower threaded nut, said upper nut disposed on said rod and interfacing with said upper socket, and said lower nut disposed on said rod and interfacing with said hydraulic assembly;

hydraulic supply means connected with a fluid port in said hydraulic assembly to provide a selected movement of said piston in said groove;

wherein said nip dimension can vary as a function of the movement of said piston.

3. A releasable compression device as defined by claim 2 and further characterized by said upper and lower portions of said socket assemblies having complementary spherically shaped interfacing surfaces to form an adjustable joint therebetween, respectively.

4. A releasable compression device as defined by claim 2 and further characterized by said groove of said hydraulic assembly being annular.

5. A releasable compression device as defined in claim 2 and further characterized by said lower nut including an annular flange having a flat horizontal top surface engaging said hydraulic assembly and an inner cylindrical body portion engaging said rod and extending through said hydraulic assembly, said lower socket and said opening in said arm of said support frame.

6. A releasable compression device as defined in claim 5 and further characterized by said hydraulic supply means further including, an inert gas filled accumulator connected between said pump and said cylinder, and located at an elevation above said chamber, and said accumulator partially filling with said fluid as a pressure on said fluid increases.

7. A releasable compression device as defined in claim 5 and further characterized by said pump being a manually operated pump.

8. A releasable compression device as defined in claim 2 and further characerized by said hydraulic supply means further including a hydraulic pump connected to said fluid port for pumping a hydraulic fluid into a chamber formed in said groove by said disposed piston to apply a force to move said piston and said cylinder vertically.

9. A releasable compression device as defined by claim 8 and further characterized by said hydraulic supply means including a valving means connected between said pump and said accumulator, said means providing a shut-of to maintain said fluid under a constant pressure between said valving means and said cylinder.

10. A releasable compression device as defined by claim 8 and further characterized by said hydraulic supply means including a measuring device connected to said hydraulic supply means to measure the pressure of said fluid, said device calibrated to indicate a force necessary to cause said nip to expand.

11. A crushing mill having a releasable compression device to allow the non-destructive passage of foreign matter through said mill comprising:

first and second rollers positioned in parallel crushing relationship with a crushing nip therebetween;

arm means for adjutably positioning the axis of the second roller relative to the first roller;

first and second fixed stops limiting the movement of the second roller toward and away from the first roller, respectively;

and yieldable and expansible means acting between the second stop and the arm means urging the second roller arm means againt said first fixed stop with a pressure in excess of that encountered by normal crushing operation so that the second roller moves away from said first fixed stop against the yieldable means upon passage of a foreign object through the nip.

12. A crushing mill having a releasable compression device to allow the non-destructive passage of foreign matter through said mill constructed in accordance with claim 11 wherein said yieldable means includes a fluid pressure chamber with a movable surface attached to urge the second roller against said first fixed stop wherein displacement of the fluid in said chamber can occur with passage of a foreign object through the nip.

13. A crushing mill havng a releasable compression device to allow the non-destructive passage of foreign matter through said mill constructed in accordance with claim 12 wherein said fluid includes a fluid having a compressible characteristic.

14. The method of controlling the nip size between a pair of crushing rollers while permitting foreign objects to pass non-destructively through the nip between the rollers comprising the steps:

providing first and second fixed stops and yieldable and expansible pressure means;

adjustably positioning said first fixed stop so as to limit the movement of one of the rollers toward the other via arm means to determine the nip size;

and urging said one roller against the first stop with said expansible and yieldable pressure means acting between the arm means and the second stop with a pressure which is in excess of that encountered by normal crushing operation so that the second roller moves away from said first fixed stop against the yieldable means upon passage of a foreign object through the nip.

15. The method of controlling the nip size between a pair of crushing rollers while permitting foreign objects to pass non-destructively through the nip between the rollers in accordance with the steps of claim 14:

wherein a compressible fluid is utilized for urging the roller against the fixed stop and the pressure of the compressible fluid is controllable to accommodate yieldable movement of the roller away from the first stop but to hold the roller in a predetermined position under normal operating nip pressure.

* * * * *